US008288313B2

(12) United States Patent
Ikezawa

(10) Patent No.: US 8,288,313 B2
(45) Date of Patent: Oct. 16, 2012

(54) THERMAL RECORDING MATERIAL

(75) Inventor: Yoshimi Ikezawa, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 518 days.

(21) Appl. No.: 12/449,516

(22) PCT Filed: Feb. 13, 2008

(86) PCT No.: PCT/JP2008/052787

§ 371 (c)(1),
(2), (4) Date: Nov. 18, 2009

(87) PCT Pub. No.: WO2008/099957

PCT Pub. Date: Aug. 21, 2008

(65) Prior Publication Data

US 2010/0069240 A1 Mar. 18, 2010

(30) Foreign Application Priority Data

Feb. 14, 2007 (JP) ..... 2007-033648

(51) Int. Cl.
*B41M 5/333* (2006.01)
*B41M 5/337* (2006.01)

(52) U.S. Cl. ..... 503/207; 503/216

(58) Field of Classification Search ..... None
See application file for complete search history.

(56) References Cited

U.S. PATENT DOCUMENTS

| | | | | |
|---|---|---|---|---|
| 4,311,758 | A | 1/1982 | Oeda et al. | |
| 5,935,899 | A | 8/1999 | Suzaki et al. | |
| 6,228,804 | B1 * | 5/2001 | Nakashima | 503/226 |

FOREIGN PATENT DOCUMENTS

| | | |
|---|---|---|
| JP | 50-30539 | 3/1975 |
| JP | 53-86229 | 7/1978 |
| JP | 62-53879 | 3/1987 |
| JP | 6-48039 | 2/1994 |
| JP | 9-142026 | 6/1997 |
| JP | 10-297089 | 11/1998 |
| JP | 10-297090 | 11/1998 |
| JP | 2002-86911 | 3/2002 |
| JP | 2003-276337 | 9/2003 |
| JP | 2004-291613 | 10/2004 |
| JP | 2005-96323 | 4/2005 |
| JP | 2005-288744 | 10/2005 |

OTHER PUBLICATIONS

International Search Report issued Apr. 22, 2008 in International (PCT) Application No. PCT/JP2008/052787 of which the present application is the U.S. National Stage.

English Written Opinion of the International Searching Authority (PCT/ISA/237) issued Apr. 22, 2008 in International Application No. PCT/JP2008/052787 of which the present application is the U.S. National Stage.

* cited by examiner

*Primary Examiner* — Bruce H Hess
(74) *Attorney, Agent, or Firm* — Wenderoth, Lind & Ponack, L.L.P.

(57) ABSTRACT

A thermal recording material comprises a support and a thermal recording layer formed thereon, the thermal recording layer containing an electron-donating dye precursor and an electron-receiving developer that causes said dye precursor to develop a color, wherein said thermal recording layer contains vapor-phase synthesis silica, preferably, the vapor-phase synthesis silica has a specific surface area, measured by a BET method, of 50 to 200 $m^2/g$ and further is doped with aluminum oxide, and the thermal recording layer further contains the above vapor-phase synthesis silica and a diphenyl sulfones-bridged type compound, and the thermal recording material is excellent in anti-sticking property and image stability.

4 Claims, No Drawings

THERMAL RECORDING MATERIAL

FIELD OF THE INVENTION

This invention relates to a thermal recording material excellent in anti-sticking property and image stability.

BACKGROUND ART

Generally, a thermal recording material has a substrate and a heat-sensitive recording layer that is formed thereon and that contains, as main components, a generally colorless or light-colored electron-donating dye precursor and an electron-accepting developer. When the thermal recording material is heated with a thermal head, a hot pen or a laser beam, the dye precursor and the electron-accepting developer readily react with each other to give a colored image. Such thermal recording materials are used in broad fields of measuring recorders, facsimile machines, POS printers, ATM/CD, handy terminals, labeling machines, automatic vending machines of railway tickets, and the like, owing to advantages that recording apparatuses for them are so simple that their maintenance is easy and that they make no noise.

In recent years, thermal recording apparatus have made progress in downsizing, high-speed printing and power consumption reduction, and a thermal recording material is required to have an excellent "anti-sticking property". "Sticking" refers to a series of phenomena that occur since a thermal head and a thermal recording material stick to each other during printing under heat with the thermal head, and it specifically refers to an abnormal noise made during printing, non-printing spot(s) in the form of white streak(s), printed characters that are shrunken in the printing paper feeding direction, and the like. It degrades the continuous printability and printing quality that should originally be smooth. When a recording apparatus is poor in the strength of feeding a recording sheet or in particular when printing is practiced in a low-temperature environment, the sticking is liable to take place. For improving thermal recording materials in the anti-sticking property, therefore, there is a method in which a lubricant such as a fatty acid metal salt or waxes are incorporated (e.g., see JP 50-30539A) or a method in which an oil-absorbing pigment is incorporated (e.g., see JP 53-86299A). In these methods, it is difficult to attain a sufficient anti-sticking property with a recording apparatus that is poor in the strength of feeding a recording sheet or in a low-temperature printing environment.

Further, as thermal recording materials have come to be used in various fields, it is required to improve "image stability", i.e., to maintain a ground whiteness and concurrently keep a color from vanishing. A method of incorporating a diphenyl sulfones-bridged type compound is effective as a method of achieving image stability (for example, see JP10-297089A and JP10-297090A). However, it is known that this method entails a decrease in anti-sticking property, and even if the above lubricant or oil-absorbing pigment is incorporated, this method has a slight effect on the improvement of anti-sticking property. It is hence demanded to improve the anti-sticking property sufficiently.

It is essential to satisfy both the anti-sticking property and the image stability at high levels, and there are a number of proposals to form a protective layer on a thermal recording layer, and there are found methods of incorporating a specific pigment (for example, see JP62-53879A, JP9-142026A and JP2002-86911A). In these proposals, however, the protective layer per se hampers the efficiency of color development, and there is hence a great decrease in coloring sensitivity. In particular, when the printing speed of a printing apparatus is increased or when the power consumption is reduced by decreasing printing energy, the print density is liable to be decreased. Further, when a thermal recording material has a protective layer, the number of steps of production thereof is larger than that of a counterpart having no protective layer, and the production cost thereof is higher.

DISCLOSURE OF THE INVENTION

Problems to be Solved by the Invention

It is an object of this invention to provide a thermal recording material excellent in anti-sticking property and, further, excellent in image stability.

Means to Solve the Problems

The present inventor has made diligent studies and as a result has arrived at the thermal recording material of the present invention that can achieve the object. That is, this invention has a characteristic feature in a thermal recording material comprising a support and a thermal recording layer formed thereon, the thermal recording layer containing an electron-donating dye precursor and an electron-receiving developer that causes the above dye precursor to develop a color, wherein the thermal recording layer contains vapor-phase synthesis silica in the thermal recording layer. This invention includes a preferred embodiment in which the above vapor-phase synthesis silica has a BET specific surface area of 50 to 200 $m^2/g$, further includes a preferred embodiment in which the above vapor-phase synthesis silica is doped with aluminum oxide, further includes a preferred embodiment in which the above vapor-phase synthesis silica has an average secondary particle diameter of 500 nm or less, and further includes a preferred embodiment in which the thermal recording layer contains the above vapor-phase synthesis silica and a diphenyl sulfones-bridged type compound of the following general formula (1),

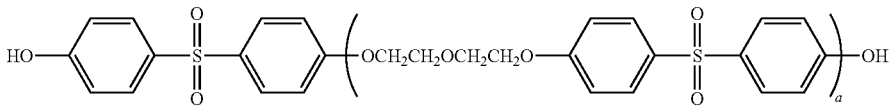

(1)

wherein a is an integer of 1 to 7.

Effect of the Invention

This invention achieves an excellent anti-sticking property by incorporating a vapor-phase synthesis silica into a thermal recording layer, preferably, by ensuring that the above vapor-phase synthesis silica has a BET specific surface area of 50 to 200 $m^2/g$, further by doping the above vapor-phase synthesis silica having the above specific surface area with aluminum oxide, and further by ensuring that the above vapor-phase synthesis silica has an average secondary particle diameter of 500 nm or less. Further, this invention achieves an excellent anti-sticking property and image stability by incorporating the above vapor-phase synthesis silica and a diphenyl sulfones-bridged type compound of the general formula (1).

PREFERRED EMBODIMENTS OF THE INVENTION

This invention will be explained more specifically bellow. The thermal recording material of this invention comprises a support and a thermal layer formed on the support, the thermal layer containing an electron-donating dye precursor and an electron-accepting developer as main components and containing a vapor-phase synthesis silica. In a preferred embodiment, the above vapor-phase synthesis silica has a specific surface area of 50 to 200 $m^2/g$, the vapor-phase synthesis silica having the above specific surface area is doped with aluminum oxide, the above vapor-phase synthesis silica has an average secondary particle diameter of 500 nm or less, and further, the thermal layer contains the above vapor-phase synthesis silica and a diphenyl sulfones-bridged type compound of the general formula (1). The thermal layer may contain, as required, an adhesive, a heat-meltable compound, a stability improver and various pigments which are known in the field of the thermal recording material.

The vapor-phase synthesis silica that is contained in the thermal recording layer will be described. Silica refers to amorphous synthesis silica, and the synthesis method thereof is classified into a wet method and a vapor-phase method. Generally, silica fine particles refer to wet method synthesis silica in many cases. The wet method synthesis silica includes silica sol obtained by the metathesis of sodium silicate with an acid or through an ion exchange resin layer, colloidal silica obtained by heating and aging silica sol, silica gel obtained by causing silica sol to gel, precipitation silica obtained by reacting sodium silicate and an acid under an alkaline condition and aggregation-precipitating silica particles, and synthesis silicic acid compounds composed mainly of silicic acid such as compounds obtained by heating silica sol, sodium silicate, sodium aluminate, etc., to generate the compounds. Silica fine particles obtained according to these wet methods characteristically have a porous structure and have a large specific surface area (200 to 1,000 $m^2/g$). Generally, it is thought that the purpose in the use of silica fine particles in a thermal recording material is to utilize the high porosity thereof in order to adsorb heat-meltable components such as an electron-donating dye precursor and an electron-accepting developer as main components in a thermal recording layer during printing under heat with a thermal head and hence to prevent the adherence of such components to the thermal head as foreign matter so that the anti-sticking property is improved. However, while silica fine particles obtained according to any wet method decrease the adherence of foreign matter to the thermal head, they deteriorate the fluidity of a heat-melted substance as a whole in a thermal recording layer, that is, they work to rather increase the viscousness thereof. The thermal recording layer and the thermal head are liable to easily adhere to each other, and printing shrinkage, etc., occur, so that they are not sufficient for improving the anti-sticking property. Further, silica fine particles obtained according to any wet method are liable to cause a great decrease in coloring sensitivity and a decrease in the layer strength of a thermal recording layer.

On the other hand, the vapor-phase synthesis silica used in this invention is also called dry method silica, and generally, it is amorphous synthesis silica produced by a flame hydrolysis method. Specifically, there is generally known a method in which it is produced by firing silicon tetrachloride together with hydrogen and oxygen. In place of the silicon tetrachloride, however, silanes such as methyltrichlorosilane, trichlorosilane, etc., can be used singly or in the state of being mixed with silicon tetrachloride. The vapor-phase synthesis silica has a primary particle size and a particle size distribution that are controlled in the range of size of several to several tens nm depending upon the condition of the flame hydrolysis, and it has large and small aggregate states. Great differences of the vapor-phase synthesis silica from any wet method synthesis silica are that they are non-porous and that they have a smaller specific surface area than the wet method synthesis silica. Generally, vapor-phase synthesis silica has a specific surface area of 50 to 400 $m^2/g$, while the specific surface area of the vapor-phase synthesis silica used in this invention is preferably smaller or 50 to 200 $m^2/g$, more preferably in the range of 50 to 100 $m^2/g$. In this invention, the specific surface area is that which is measured and calculated by a BET method, and it is a method in which a total surface area that 1 g of a sample has, i.e., a specific surface area is determined from an adsorption isotherm. As an adsorption gas, nitrogen gas is often used, and an adsorption amount is measured on the basis of a change in the pressure or volume of a gas that is adsorbed. What is called a BET expression (Brunauer-Emmerit-Teller' expression) is the most famous for showing the isotherm of multimolecular adsorption, and an adsorption amount is determined on the basis of the BET expression and multiplied by an area that one adsorbing molecule occupies on a surface, whereby a surface area can be obtained.

Another property that the vapor-phase synthesis silica in this invention has different from that of any wet method synthesis silica is that the bulk density thereof is smaller than that of any wet method synthesis silica, and in the iron cylinder method of JIS K6220, a wet method synthesis silica has a bulk density of 0.14 g/cc or more, whereas the vapor-phase synthesis silica in this invention has a bulk density of as small as 0.05 to 0.13 g/cc. This shows that the vapor-phase synthesis silica takes a bulky network structure and has a large interparticle space.

The effect that the anti-sticking property is improved by the vapor-phase synthesis silica in this invention is what cannot be obtained by using general silica fine particles. Any one of the adherence of a thermal recording layer and a thermal head to each other, the adherence of foreign matter to a thermal head, the printing shrinkage, etc., can be overcome, and that there is caused no decrease in coloring sensitivity or layer strength. As a reason therefor, with a decrease in the specific surface area of the vapor-phase synthesis silica in this invention, it has a smaller aggregate structure, and, although it only produces a little effect on the adsorption of a heat-melted substance, it is assumed that the above performances are based on an effect that it remarkably reduces the high viscousness of the heat-melted substance and an effect that primary particles encompass the heat-melted substance in large inter-particle spaces, these effects being based on the behavior of its spherical primary particles having only outer surfaces and having a diameter of several tens nm.

As the vapor-phase synthesis silica in this invention, AEROSIL and its dispersion, AERODISP, supplied by NIPPON AEROSIL CO., LTD. and Reolosil supplied by TOKUYAMA Corp. are commercially available. Specific examples thereof include AEROSIL OX50 (specific surface area 50 $m^2/g$, bulk density 0.13 g/cc), ditto 90 G (specific surface area 90 $m^2/g$, bulk density 0.08 g/cc), ditto 130 (specific surface area 130 $m^2/g$, bulk density 0.05 g/cc), ditto 200 (specific surface area 200 $m^2/g$, bulk density 0.10 g/cc), ditto 300 G (specific surface area 300 $m^2/g$, bulk density 0.05 g/cc) and AERODISP W1226 as an aqueous dispersion of AEROSIL OX50.

In this invention, there can be preferably used vapor-phase synthesis silica that has a specific surface area of 50 to 200 $m^2/g$ and that is doped with aluminum oxide. It is a metal oxide that is obtained by mixing silicon tetrachloride with a small amount of aluminum chloride and flame-hydrolyzing the mixture and that contains a mixture of silica and aluminum oxide in each primary particle. For example, AEROSIL MOX80 (specific surface area 80 $m^2/g$, bulk density 0.06 g/cc, aluminum oxide content 0.3 to 1.3%) and ditto MOX 170 (specific surface area 170 $m^2/g$, bulk density 0.05 g/cc, aluminum oxide content 0.3 to 1.3%) from NIPPON AEROSIL CO., LTD. are commercially available. Further, as an aqueous dispersion of AEROSIL MOX80, AERODISP W1824, ditto W1836 is commercially available, and as an aqueous dispersion of AEROSIL MOX170, ditto W1714 is commercially available. It is expected that vapor-phase synthesis silica doped with a small amount of aluminum oxide is improved in dispersibility as compared with one that is not doped with aluminum oxide, and it has a higher effect on improvement of the anti-sticking property that is intended in this invention. As other improvement effect produced by doping vapor-phase synthesis silica with aluminum oxide, the surface activity of silica particles is decreased, so that no ground fogging in a thermal recording layer is observed as compared with non-doped vapor-phase synthesis silica.

The vapor-phase synthesis silica has a secondary aggregate state where primary particles having a size of several nm to several tens nm each are linked in the form of a network structure or chains. When this vapor-phase synthesis silica is incorporated into a thermal recording layer, it is preferably dispersed until it has an average secondary diameter of 500 nm or less, more preferably, 300 nm. When the average secondary particle diameter of the vapor-phase synthesis silica exceeds 500 nm, it has an adverse effect on the fluidity and application property of a coating liquid containing the vapor-phase synthesis silica, the surface smoothness of a coating layer, etc., and a thermal recording layer may sometimes undergo cracking, etc., which are not only undesirable for an improvement effect on the anti-sticking property but may sometimes impair the quality of a color-developed image. The average secondary particle diameter of aggregate particles can be determined by means of the taking of a photograph with a transmission electron microscope, a laser diffraction/scattering particle size distribution analyzer, etc.

In this invention, for adjusting the average particle diameter of the vapor-phase synthesis silica to 500 nm or less, preferably, preliminary mixing is carried out with a general propeller stirring, a turbine type stirrer, a homomixer type stirrer, etc., in the co-presence of a dispersing medium and optionally, a dispersing agent and a pH adjuster, and then dispersing is carried out by means of a media mill such as a ball mill, a bead mill, a sand grinder, etc., a pressure dispersing apparatus such as a high-pressure homogenizer, an ultra-high-pressure homogenizer, etc., an ultrasonic dispersing apparatus, or a thin-film revolution type dispersing apparatus.

In this invention, the content of the vapor-phase synthesis silica is not specially limited, while it is preferably 1 to 400 mass %, more preferably 5 to 200 mass %, based on the electron-donating dye precursor. When the above content is less than 1 mass %, the improvement effect on the anti-sticking property is not exhibited. When it is greater than 400 mass %, no further improvement in the anti-sticking property can be expected, and a ground fogging is liable to take place.

The diphenyl sulfones-bridged type compound of the general formula (1) in this invention is used as an electron-accepting developer or a stability improving agent and exhibits excellent image stability. Since, however, it becomes a highly viscous compound in a thermally melted state, it degrades the anti-sticking property. However, when it is used together with the vapor-phase synthesis silica in this invention, the anti-sticking property can be greatly improved without degrading the coloring sensitivity or image stability. The content of the diphenyl sulfones-bridged type compound in this invention is not specially limited, while it is preferably 5 to 500 mass % based on the electron-donating dye precursor. When the above content is less than 5 mass %, the improvement effect on the image stability is not exhibited. When it is greater than 500 mass %, a thermal recording layer fully has image stability, but suffers sticking to a great extent.

The electron-donating dye precursor in this invention can be selected from compounds that are generally used in a pressure-sensitive recording material or a thermal recording material, and the color tone thereof is not specially limited. Specific examples thereof include the following compounds, while this invention shall not be limited thereto.

Black dye precursors such as 3-di-n-butylamino-6-methyl-7-anilinofluorane, 3-di-n-pentylamino-6-methyl-7-anilinofluorane, 3-diethylamino-6-methyl-7-anilinofluorane, 3-di-n-butylamino-7-(2-chloroanilino)fluorane, 3-diethylamino-7-(2-chloroanilino)fluorane, 3-diethylamino-6-methyl-7-xylidinofluorane, 3-diethylamino-7-(2-carbomethoxyphenylamino)fluorane, 3-(N-cyclohexyl-N-methyl)amino-6-methyl-7-anilinofluorane, 3-(N-cyclopentyl-N-ethyl)amino-6-methyl-7-anilinofluorane, 3-(N-isoamyl-N-ethyl)amino-6-methyl-7-anilinofluorane, 3-(N-ethyl-4-toluidino)-6-methyl-7-anilinofluorane, 3-(N-ethyl-4-toluidino)-6-methyl-7-(4-toluidino)fluorane, 3-(N-methyl-N-tetrahydrofurfuryl)amino-6-methyl-7-anilinofluorine, 3-pyrrolidino-6-methyl-7-anilinofluorane, 3-pyrrolidino-6-methyl-7-(4-n-butylphenylamino)fluorane and 3-piperidino-6-methyl-7-anilinofluorane.

Red dye precursors such as 3,3-bis(1-n-butyl-2-methylindol-3-yl)phthalide,3,3-bis(1-n-butyl-2-methylindol-3-yl)tetrachlorophthalide, 3,3-bis(1-n-butylindol-3-yl)phthalide, 3,3-bis(1-n-pentyl-2-methylindol-3-yl)phthalide, 3,3-bis(1-n-hexyl-2-methylindol-3-yl)phthalide, 3,3-bis(1-n-octyl-2-methylindol-3-yl)phthalide, 3,3-bis(1-methyl-2-methylindol-3-yl)phthalide, 3,3-bis(1-ethyl-2-methylindol-3-yl) phthalide, 3,3-bis(1-propyl-2-methylindol-3-yl)phthalide, 3,3-bis(2-methylindol-3-yl)phthalide, rhodamine B anilinolactam, rhodamine B-(o-chloroanilino)lactam, rhodamine B-(p-nitroanilino)lactam, 3-diethylamino-5-methyl-7-dibenzylaminofluorane, 3-diethylamino-6-methyl-7-chlorofluorane, 3-diethylamino-6-methoxyfluorane, 3-diethylamino-6-methylluorane, 3-diethylamino-6-methyl-7-chloro-8-benzylfluorane, 3-diethylamino-6,7-dimethyl-fluorane, 3-diethylamino-6,8-dimethylfluorane, 3-diethylamine-7-chlorofluorane, 3-diethylamino-7-methoxyfluorane, 3-diethylamino-7-(N-acetyl-N-methyl)aminofluorane, 3-diethylamino-7-methylfluorane, 3-diethylamino-7-n-propoxyfluorane, 3-diethylamino-7-p-methylphenylfluorane, 3-diethylamino-7,8-fluorane, 3-diethylaminobenzo[a]fluorane, 3-diethylaminobenzo[c] fluorane, 3-dimethylamino-7-methoxyfluorane, 3-dimethylamino-6-methyl-7-chlorofluorane, 3-dimethylamino-7-methylfluorane, 3-dimethylamino-7-chlorofluorane, 3-(N-ethyl-p-toluidino)-7-methylfluorane, 3-(N-ethyl-N-isoamyl) amino-6-methyl-7-chlorofluorane, 3-(N-ethyl-N-isoamyl) amino-7,8-benzofluorane, 3-(N-ethyl-N-isoamyl)amino-7-methylfluorane, 3-(N-ethyl-N-n-octyl)amino-6-methyl-7-chlorofluorane, 3-(N-ethyl-N-n-octyl)amino-7,8-benzofluorane, 3-(N-ethyl-N-n-octyl)amino-7-methylfluorane, 3-(N-ethyl-N-n-octyl)amino-7-chlorofluorane, 3-(N-ethyl-N-4-methylphenyl)amino-7,8-benzofluorane, 3-(N-ethoxyethyl-N-ethyl)amino-7,8-benzofluorane, 3-(N-ethoxyethyl-N-ethyl)amino-7-chlorofluorane, 3-di-n-butylamino-6-methyl-7-chlorofluorane, 3-di-n-butylamino-7,8-benzofluorane, 3-di-n-butylamino-7-chlorofluorane, 3-di-n-butylamino-7-methylfluorane, 3-diallylamino-7,8-benzofluorane, 3-diallylamino-7-chlorofluorane, 3-di-n-butylamino-6-methyl-7-bromofluorane, 3-cyclohexylamino-6-chlorofluorane, 3-pyrrolidylamino-7-methylfluorane, 3-ethylamino-7-methylfluorane, 3-(N-ethyl-N-isomayl)amino-benzo[a]fluorane, 3-di-n-butylamino-6-methyl-7-bromofluorane and 3,6-bis (diethylaminofluorane)-γ-(4'-nitro)anilinolactam.

Green dye precursors such as 3-(N-ethyl-N-n-hexyl) amino-7-anilinofluorane, 3-(N-ethyl-N-p-tolyl)amino-7-(N-phenyl-N-methyl)aminofluorane, 3-(N-ethyl-N-n-propyl) amino-7-dibenzylaminofluorane, 3-(N-ethyl-N-n-propyl) amino-6-chloro-7-dibenzylaminofluorane, 3-(N-ethyl-N-4-methylphenyl)amino-7-(N-methyl-N-phenyl) aminofluorane, 3-(N-ethyl-4-methylphenyl)amino-7-dibenzylaminofluorane, 3-(N-ethyl-4-methylphenyl)amino-6-methyl-7-dibenzylaminofluorane, 3-(N-ethyl-4-methylphenyl)amino-6-methyl-7-(N-methyl-N-benzyl) aminofluorane, 3-(N-methyl-N-n-hexyl)amino-7-anilinofluorane, 3-(N-propyl-N-n-hexyl)amino-7-anilinofluorane, 3-(N-ethoxy-N-n-hexyl)amino-7-anilinofluorane, 3-(N-n-pentyl-N-allyl)amino-6-methyl-7-anilinofluorane, 3-(N-n-pentyl-N-allyl)amino-7-anilinofluorane, 3-di-n-butylamino-6-chloro-7-(2-chloroanilino)fluorane, 3-di-n-butylamino-6-methyl-7-(2-chloroanilino)fluorane, 3-di-n-butylamino-6-methyl-7-(2-fluoroanilino)fluorane, 3-di-n-dibutylamino-7-(2-chloroanilino)fluorane, 3-di-n-dibutylamino-7-(2-chlorobenzylanilino)fluorane, 3,3-bis(4-diethylamino-2-ethoxyphenyl)-4-azaphthalide, 3,6-bis(dimethylamino) fluorene-9-spiro-3'-(6'-dimethylamino)phthalide, 3-diethylamino-6-methyl-7-benzylaminofluorane, 3-diethylamino-6-methyl-7-dibenzylaminofluorane, 3-diethylamino-6-methyl-7-n-octylaminofluorane, 3-diethylamino-6-methyl-7-(N-cyclohexyl-N-benzyl)aminofluorane, 3-diethylamino-6-methyl-7-(2-chloroanilino)fluorane, 3-diethylamino-6-methyl-7-(2-trifluoromethylanilino)fluorane, 3-diethylamino-6-methyl-7-(3-trifluoromethylanilino)fluorane, 3-diethylamino-6-methyl-7-(2-ethoxyanilino)fluorane, 3-diethylamino-6-methyl-7-(4-ethoxyanilino)fluorane, 3-diethylamino-6-chloro-7-(2-chloroanilino)fluorane, 3-diethylamino-6-chloro-7-dibenzylaminofluorane, 3-diethylamino-6-chloro-7-anilinofluorane, 3-diethylamino-6-ethylethoxy-7-anilinofluorane, 3-diethylamino-7-anilinofluorane, 3-diethylamino-7-methylanilinofluorane, 3-diethylamino-7-dibenzylaminofluorane, 3-diethylamino-7-n-octylaminofluorane, 3-diethylamino-7-p-chloroanilinofluorane, 3-diethylamino-7-p-methylphenylanilinofluorane, 3-diethylamino-7-(N-cyclohexyl-N-benzyl)aminofluorane, 3-diethylamino-7-(2-chloroanilino)fluorane, 3-diethylamino-7-(3-trifluoromethylanilino)fluorane, 3-diethylamino-7-(2-trifluoromethylanilino)fluorane, 3-diethylamino-7-(2-ethoxyanilino)fluorane, 3-diethylamino-7-(4-ethoxyanilino)fluorane, 3-diethylamino-7-(2-chlorobenzylanilino)fluorane, 3-dimethylamino-6-chloro-7-dibenzylaminofluorane, 3-dimethylamino-6-methyl-7-n-octylaminofluorane, 3-dimethylamino-7-dibenzylaminofluorane, 3-dimethylamino-7-n-octylaminofluorane, 3-di-n-butylamino-7-(2-fluoroanilino) fluorane, 3-anilino-7-dibenzylaminofluorane, 3-anilino-6-methyl-7-dibenzylaminofluorane, 3-pyrrodino-7-dibenzylaminofluorane, 3-pyrrodino-7-(4-cyclohexylanilino)fluorane, 3-dibenzylamino-6-methyl-7-dibenzylaminofluorane, 3,7-bis(dibenzylamino)fluorane and 3-dibenzylamino-7-(2-chloroanilino)fluorane.

Blue dye precursors such as 3-(2-ethyl-2-methylindol-3-yl)-3-(3-diethylaminophenyl)phthalide, 3-(1-ethyl-2-methylindol-3-yl)-3-(2-methyl-4-diethylaminophenyl)-4-azaphthalide, 3-(1-ethyl-2-methylindol-3-yl)-3-(2-ethoxy-4-aminophenyl)-4-azaphthalide, 3-(1-ethyl-2-methylindol-3-yl)-3-(2-ethoxy-4-methylaminophenyl)-4-azaphthalide, 3-(1-ethyl-2-methylindol-3-yl)-3-(2-ethoxy-4-ethylaminophenyl)-4-azaphthalide, 3-(1-ethyl-2-methylindol-3-yl)-3-(2-ethoxy-4-dimethylaminophenyl)-4-azaphthalide, 3-(1-ethyl-2-methylindol-3-yl)-3-(2-ethoxy-4-diethylaminophenyl)-4-azaphthalide, 3-(1-ethyl-2-methylindol-3-yl)-3-(2-ethoxy-4-di-n-propylaminophenyl)-4-azaphthalide, 3-(1-ethyl-2-methylindol-3-yl)-3-(2-ethoxy-4-di-n-butylaminophenyl)-4-azaphthalide, 3-(1-ethyl-2-methylindol-3-yl)-3-(2-ethoxy-4-di-n-pentylaminophenyl)-4-azaphthalide, 3-(1-ethyl-2-methylindol-3-yl)-3-(2-ethoxy-4-di-n-hexylaminophenyl)-4-azaphthalide, 3-(1-ethyl-2-methylindol-3-yl)-3-(2-ethoxy-4-dihydroxyaminophenyl)-4-azaphthalide, 3-(1-ethyl-2-methylindol-3-yl)-3-(2-ethoxy-4-dichloroaminophenyl)-4-azaphthalide, 3-(1-ethyl-2-methylindol-3-yl)-3-(2-ethoxy-4-dibromoaminophenyl)-4-azaphthalide, 3-(1-ethyl-2-methylindol-3-yl)-3-(2-ethoxy-4-diallylaminophenyl)-4-azaphthalide, 3-(1-ethyl-2-methylindol-3-yl)-3-(2-ethoxy-4-dihydroxyaminophenyl)-4-azaphthalide, 3-(1-ethyl-2-methylindol-3-yl)-3-(2-ethoxy-4-dimethoxyaminophenyl)-4-azaphthalide, 3-(1-ethyl-2-methylindol-3-yl)-3-(2-ethoxy-4-diethoxyaminophenyl)-4-azaphthalide, 3-(1-ethyl-2-methylindol-3-yl)-3-(2-ethoxy-4-dicyclohexylaminophenyl)-4-azaphthalide, 3-(1-ethyl-2-methylindol-3-yl)-3-(2-ethoxy-4-di-n-propoxyaminophenyl)-4-azaphthalide, 3-(1-ethyl-2-methylindol-3-yl)-3-(2-ethoxy-4-di-n-butoxyaminophenyl)-4-azaphthalide, 3-(1-ethyl-2-methylindol-3-yl)-3-(2-ethoxy-4-di-n-hexyloxyaminophenyl)-4-azaphthalide, 3-(1-ethyl-2-methylindol-3-yl)-3-(2-ethoxy-4-di-methylcyclohexylaminophenyl)-4-azaphthalide, 3-(1-ethyl-2-methylindol-3-yl)-3-(2-ethoxy-4-di-methoxycyclohexylaminophenyl)-4-azaphthalide, 3-(1-ethyl-2-methylindol-3-yl)-3-(2-ethoxy-4-pyrrolidylaminophenyl)-4-azaphthalide, 3-(1-ethyl-2-methylindol-3-yl)-3-(3-ethoxy-4-diethylaminophenyl)-4-azaphthalide, 3-(1-ethyl-2-methylindol-3-yl)-3-(2,3-diethoxy-4-diethylaminophenyl)-4-azaphthalide, 3-(1-ethyl-2-methylindol-3-yl)-3-(4-diethylaminophenyl)-4-azaphthalide, 3-(1-ethyl-2-methylindol-3-yl)-3-(2-chloro-4-diethylaminophenyl)-4-azaphthalide, 3-(1-ethyl-2-methylindol-3-yl)-3-(3-chloro-4-diethylaminophenyl)-4-azaphthalide, 3-(1-ethyl-2-methylindol-3-yl)-3-(2-bromo-4-diethylaminophenyl)-4-azaphthalide, 3-(1-ethyl-2-methylindol-3-yl)-3-(3-bromo-4-diethylaminophenyl)-4-azaphthalide, 3-(1-ethyl-2-methylindol-3-yl)-3-(2-ethyl-4-diethylaminophenyl)-4-azaphthalide, 3-(1-ethyl-2-methylindol-3-yl)-3-(2-n-propyl-4-diethylaminophenyl)-4-azaphthalide, 3-(1-ethyl-2-methylindol-3-yl)-3-(3-methyl-4-diethylaminophenyl)-4-azaphthalide, 3-(1-ethyl-2-methylindol-3-yl)-3-(2-nitro-4-diethylaminophenyl)-4-azaphthalide, 3-(1-ethyl-2-methylindol-3-yl)-3-(2-allyl-4-diethylaminophenyl)-4-azaphthalide, 3-(1-ethyl-2-methylindol-3-yl)-3-(2-hydroxy-4-diethylaminophenyl)-4-azaphthalide, 3-(1-ethyl-2-methylindol-3-yl)-3-(2-cyano-4-diethylaminophenyl)-4-azaphthalide, 3-(1-ethyl-2-methylindol-3-yl)-3-(2-cyclohexylethoxy-4-diethylaminophenyl)-4-azaphthalide, 3-(1-ethyl-2-methylindol-3-yl)-3-(2-methylethoxyethoxy-4-diethylaminophenyl)-4-azaphthalide, 3-(1-ethyl-2-methylindol-3-yl)-3-(2-cyclohexylethyl-4-diethylaminophenyl)-4-azaphthalide, 3-(2-ethylindol-3-yl)-3-(2-ethoxy-4-diethylaminophenyl)-4-azaphthalide, 3-(1-ethyl-2-chloroindol-3-yl)-3-(2-ethoxy-4-diethylaminophenyl)-4-azaphthalide, 3-(1-ethyl-2-bromoindol-3-yl)-3-(2-ethoxy-4-diethylaminophenyl)-4-azaphthalide, 3-(1-ethyl-2-ethylindol-3-yl)-3-(2-ethoxy-4-diethylaminophenyl)-4-azaphthalide, 3-(1-ethyl-2-propylindol-3-yl)-3-(2-ethoxy-4-diethylaminophenyl)-4-azaphthalide, 3-(1-ethyl-2-methoxyindol-3-yl)-3-(2-ethoxy-4-diethylaminophenyl)-4-azaphthalide, 3-(1-ethyl-2-ethoxyindol-3-yl)-3-(2-ethoxy-4-diethylaminophenyl)-4-azaphthalide, 3-(1-ethyl-2-phenylindol-3-yl)-3-(2-ethoxy-4-diethylaminophenyl)-4-azaphthalide, 3-(1-ethyl-2-methylindol-3-yl)-3-(2-ethoxy-4-diethylaminophenyl)-7-azaphthalide, 3-(1-ethyl-2-methylindol-3-yl)-3-(2-ethoxy-4-diethylaminophenyl)-4,7-diazaphthalide, 3-(1-ethyl-4,5,6,7-tetrachloro-2-methylindol-3-yl)-3-(2-ethoxy-4-diethylaminophenyl)-4-azaphthalide, 3-(1-ethyl-4-nitro-2-methylindol-3-yl)-3-(2-ethoxy-4-diethylaminophenyl)-4-azaphthalide, 3-(1-ethyl-4-methoxy-2-methylindol-3-yl)-3-(2-ethoxy-4-diethylaminophenyl)-4-azaphthalide, 3-(1-ethyl-4-methylamino-2-methylindol-3-yl)-3-(2-ethoxy-4-diethylaminophenyl)-4-azaphthalide, 3-(1-ethyl-4-methyl-2-methylindol-3-yl)-3-(2-ethoxy-4-diethylaminophenyl)-4-azaphthalide, 3-(2-methylindol-3-yl)-3-(2-ethoxy-4-diethylaminophenyl)-4-azaphthalide, 3-(1-chloro-2-methylindol-3-yl)-3-(2-ethoxy-4-diethylaminophenyl)-4-azaphthalide, 3-(1-bromo-2-methylindol-3-yl)-3-(2-ethoxy-4-diethylaminophenyl)-4-azaphthalide, 3-(1-methyl-2-methylindol-3-yl)-3-(2-ethoxy-4-diethylaminophenyl)-4-azaphthalide, 3-(1-methyl-2-methylindol-3-yl)-3-(2-ethoxy-4-diethylaminophenyl)-7-azaphthalide, 3-(1-n-propyl-2-methylindol-3-yl)-3-(2-ethoxy-4-diethylaminophenyl)-4-azaphthalide, 3-(1-n-butyl-2-methylindol-3-yl)-3-(2-ethoxy-4-diethylaminophenyl)-4-azaphthalide, 3-(1-n-butyl-2-methylindol-3-yl)-3-(2-ethoxy-4-diethylaminophenyl)-7-azaphthalide, 3-(1-n-pentyl-2-methylindol-3-yl)-3-(2-ethoxy-4-diethylaminophenyl)-4-azaphthalide, 3-(1-n-hexyl-2-methylindol-3-yl)-3-(2-ethoxy-4-diethylaminophenyl)-4-azaphthalide, 3-(1-n-hexyl-2-methylindol-3-yl)-3-(2-ethoxy-4-diethylaminophenyl)-7-azaphthalide, 3-(1-n-octyl-2-methylindol-3-yl)-3-(2-ethoxy-4-diethylaminophenyl)-4-azaphthalide, 3-(1-n-octyl-2-methylindol-3-yl)-3-(2-ethoxy-4-diethylaminophenyl)-7-azaphthalide, 3-(1-n-octyl-2-methylindol-3-yl)-3-(2-ethoxy-4-diethylaminophenyl)-4,7-diazaphthalide, 3-(1-n-nonyl-2-methylindol-3-yl)-3-(2-ethoxy-4-diethylaminophenyl)-4-azaphthalide, 3-(1-methoxy-2-methylindol-3-yl)-3-(2-ethoxy-4-diethylaminophenyl)-4-azaphthalide, 3-(1-ethoxy-2-methylindol-3-yl)-3-(2-ethoxy-4-diethylaminophenyl)-4-azaphthalide, 3-(1-phenyl-2-methylindol-3-yl)-3-(2-ethoxy-4-diethylaminophenyl)-4-azaphthalide, 3-(1-n-pentyl-2-methylindol-3-yl)-3-(2-ethoxy-4-diethylaminophenyl)-7-azaphthalide, 3-(1-n-heptyl-2-methylindol-3-yl)-3-(2-ethoxy-4-diethylaminophenyl)-7-azaphthalide, 3-(1-n-nonyl-2-methylindol-3-yl)-3-(2-ethoxy-4-diethylaminophenyl)-7-azaphthalide, 3,3-bis(4-dimethylaminophenyl)-6-dimethylaminopthalide, 3-(4-dimethylamino-2-methylphenyl)-3-(4-dimethylaminophenyl)-6-dimethylaminophthalide and 3-(1-ethyl-2-methylindol-3-yl)-3-(3-diethylamino-2-n-hexyloxyphenyl)-4-azaphthalide. These may be used singly or as a mixture of two or more of them.

Further, there are functional dye precursors having absorption in a near infrared region. When such a dye precursor is used singly as a high-temperature color-forming dye precursor or used in combination with other dye precursor, there can be formed an image whose high-temperature color-developed image has absorption in a near infrared region and that can be readable with a near infrared lamp.

Dyes having absorption in a near infrared region include 3,3-bis[1-(4-methoxyphenyl)-1-(4-dimethylaminophenyl) ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, 3,3-bis[1,1-bis(4-pyrrolidinophenyl)ethylen-2-yl]-4,5,6,7-tetrabromophthalide, 3-[1,1-bis(p-diethylaminophenyl) ethylen-2-yl]-6-dimethylaminophthalide, 3,6-bis (dimethylaminophenyl)ethylen-2-yl]-6-dimethylaminophthalide, 3-[p-(p-dimethylaminoanilino) aniline]-6-methylfluorane, 3-[p-(p-dimethylaminoanilino) aniline]-6-methyl-7-chlorofluorane, 3-(p-n-butylaminoanilino)-6-methyl-7-chlorofluorane, 3-[p-(p-anilinoanilino)anilino]-6-methyl-7-chlorofluorane, 3-p-(p-chloroanilino)anilino]-6-methyl-7-chlorofluorane, 3-(N-p-tolyl-N-ethylamino)-6,8,8-trimethyl-9-ethyl-8,9-dihydro(3,2,e)pyridofluorane, 3-d-n-butylamino-6,8,8-trimethyl-8,9-dihydro(3,2,e)pyridofluorane, 3'-phenyl-7-diethylamino-2,2'-spirodi-(2H-1-benzofluorane), bis(p-dimethylaminostyryl)-p-trisulfonylmethane, 3,7-bis(dimethylamino)-10-benzoylphenothiazine, etc. These dye precursors may be used singly or in combination of two or more of them as required.

The electron-accepting developer in this invention can be selected from compounds that are generally used in a thermal recording material in addition to the diphenyl sulfones-bridged type compound of the general formula (1). Specific examples thereof include the following compounds, while it shall not be limited thereto. 4,4'-dihydroxydiphenylsulfone, 2,4'-dihydroxydiphenylsulfone, 4-hydroxy-4'-propoxydiphenylsulfone, 4-hydroxy-4'-isopropoxydiphenylsulfone, 4-hydroxy-4'-allyloxydiphenylsulfone, 4-hydroxy-4'-octyloxydiphenylsulfone, 4-hydroxy-4'-dodecyloxydiphenylsulfone, 4-hydroxy-4'-benzyloxydiphenylsulfone, bis(3-allyl-4-hydroxyphenyl)sulfone, 3,4-dihydroxy-4'-methyldiphenylsulfone, 4-hydroxy-4'-benzenesulfonyloxydiphenylsulfone, 2,4-bis(phenylsulfonyl)phenol, p-phenylphenol, p-hydroxyacetophenone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl)cyclohexane, 2,2-bis(p-hydroxyphenyl)propane, 2,2-bis(p-hydroxyphenyl)hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-bis[2-(p-hydroxyphenyl)-2-propyl]benzene, 1,3-bis[2-(3,4-dihydroxyphenyl)-2-propyl]benzene, 1,4-bis[2-(p-hydroxyphenyl)-2-propyl]benzene, 4,4'-dihydroxydiphenyl ether, 3,3'-dichloro-4,4'-hydroxydiphenyl sulfide, methyl 2,2-bis(4-hydroxyphenyl)acetate, butyl 2,2-bis(4-hydroxyphenyl)acetate, 4,4'-thiobis(2-tert-butyl-5-methylphenol), dimethyl 4-hydroxyphthalate, benzyl 4-hydroxybenzoate, methyl 4-hydroxybenzoate, benzyl gallate, stearyl gallate, N,N'-diphenylthiourea, 4,4'-bis[3-(4-methylphenylsulfonyl)ureido]-diphenylmethane, N-(4-methylphenylsulfonyl)-N'-phenylurea, salicylanilide, 5-chlorosalicylanilide, salicylic acid, 3,5-do-tert-butylsalicylic acid, 3,5-di-α-methylbenzylsalicylic acid, 4-[2'-(4-methoxyphenoxy)ethyloxy]salicylic acid, 3-(octyloxycarbonylamino)salicylic acid or metal salts of these salicylic acid derivatives, N-(4-hydroxyphenyl)-p-toluenesulfoneamide, N-(4-hydroxyphenyl)benzene-sulfoneamide, N-(4-hydroxyphenyl)-1-naphthalenesulfoneamide, N-(4-hydroxyphenyl)-2-naphthalenesulfoneamide, N-(4-hydroxynaphthyl)-p-toluenesulfoneamide, N-(4-hydroxynaphthyl)benzenesulfoneamide, N-(4-hydroxynaphthyl)-1-naphthalenesulfoneamide, N-(4-hydroxynaphthyl)-2-naphthalenesulfoneamide, N-(3-hydroxyphenyl)p-toluenesulfoneamide, N-(3-hydroxyphenyl)benzenesulfoneamide, N-(3-hydroxyphenyl)-1-naphthalenesulfoneamide, N-(3-hydroxyphenyl)-2-naphthalenesulfoneamide, N-(4-methylphenylsulfonyl)-N'-[3-(4-methylphenylsulfonyloxy)phenyl]urea, bis(4-tosylaminocarboxyaminophenyl)methane, a ureaurethane compound, a sulfonylurea compound, etc. These electron-accepting developers can be used singly or in combination of two or more of them as required.

The amount ratio of the dye precursor and the electron-accepting developer is determined as required depending upon the kinds and combinations of these, while they are used to ensure that the total content of the electron-accepting compounds based on the total content of the dye precursors is 100 to 500 mass %, preferably 150 to 350 mass %.

In addition to the above essential or main components, the thermal recording layer in this invention may contain a known adhesive, a heat-melting compound, a stability improver, various pigments, a surfactant, etc., and there is no special limitation to be imposed thereon, while those which do not much influence on color-developing properties are particularly preferred.

Specific examples of the adhesive include starches, hydroxyethyl cellulose, methyl cellulose, ethyl cellulose, carboxymethyl cellulose, gelatin, casein, a complete saponification polyvinyl alcohol, a partial saponification polyvinyl alcohol, a carboxyl-group-modified polyvinyl alcohol, an acetoacethyl-group-modified polyvinyl alcohol, a diacetone-modified polyvinyl alcohol, a silanol-group-modified polyvinyl alcohol, a sulfonic-group-modified polyvinyl alcohol, a phosphoric-group-modified polyvinyl alcohol, a butyral-group-modified polyvinyl alcohol, an epoxy-group-modified polyvinyl alcohol, chitosan, polyacrylic acid, polymethacrylic acid, polyacrylic ester, polymethacrylic ester, sodium polyacrylate, polyethylene terephthalate, polybutylene terephthalate, chlorinated polyether, an acrylic resin, a furan resin, a ketone resin, oxybenzoyl polyester, polyacetal, polyether ether ketone, polyether sulfone, polyimide, polyamide, polyamideimide, polyaminobismaleimide, polymethylpentene, polyphenylene oxide, polyphenylene sulfide, polyphenylene sulfone, polysulfone, polyallylate, polyallyl sulfone, polybutadiene, polycarbonate, polyethylene, polypropylene, polystyrene, polyvinyl chloride, polyvinylidene chloride, polyvinyl acetate, polyurethane, a phenolic resin, a urea resin, a melamine resin, a melamine formalin resin, a benzoguanamine resin, a bismaleimide triazine resin, an alkyd resin, an amino resin, an epoxy resin, an unsaturated polyester resin, a styrene/butadiene copolymer, an acrylonitrile/butadiene copolymer, a methyl acrylate/butadiene copolymer, an ethylene/vinyl acetate copolymer, an acrylic acid amide/acrylic ester copolymer, an acrylic acid amide/acrylic ester/methacrylic acid terpolymer, an alkali salt of a styrene/maleic anhydride copolymer, an alkali salt or ammonium salt of an ethylene/maleic anhydride copolymer and other various polyolefin resins. These may be used singly or in combination of two or more of them.

The heat-melting compound is used as a sensitizer for obtaining sufficient coloring sensitivity. Examples thereof include known heat-melting compounds such as stearic acid amide, N-hydroxymethylstearic acid amide, N-stearylstearic acid amide, ethylenebisstearic acid amide, N-stearylurea, benzyl-2-naphthyl ether, m-terphenyl, 4-benzylbiphenyl, 1,2-bis(3-methylphenoxy)ethane, 1,2-diphenoxyethane, 2,2'-bis(4-methoxyphenoxy)diethyl ether, α,α'-diphenoxyxylene, bis(4-methoxyphenyl)ether, diphenyl adipate, dibenzyl oxalate, bis(4-chlorobenzyl)oxalate ester, dimethyl terephthalate, dibenzyl terephthalate, benzylparaben, phenyl benzenesulfonate ester, 4,4'-diallyloxydiphenyl sulfone, diphenyl sulfone, 4-acetylacetophenone, acetoacetic acid anilides, fatty acid anilides, salicyl anilide, etc. These compounds may be used singly or in combination of two or more of them.

The stability improver is used for improving the stability of a color-developed portion. In addition to the diphenyl sulfones-bridged type compound of the general formula (1), for example, there may be added hindered phenolic compounds such as 2,2'-methylenebis(4-methyl-6-tert-butylphenol), 2,2'-ethylenebis(4-methyl-6-tert-butylphenol), 2,2'-methylenebis(4-ethyl-6-tert-butylphenol), 2,2'-methylenebis(4,6-di-tert-butylphenol), 2,2'-ethylidenbis(4,6-di-tert-butylphenol), 2,2'-ethylidenbis(4-ethyl-6-tert-butylphenol), 2,2'-(2,2-propylidene)bis(4,6-di-tert-butylphenol), 2,2'-methylenebis(4-methoxy-6-tert-butylphenol), 2,2'-methyleneis(6-tert-butylphenol), 4,4'-thiobis(3-methyl-6-tert-butylphenol), 4,4'-thiobis(2-methyl-6-tert-butylphenol), 4,4'-thiobis(5-methyl-6-tert-butylphenol), 4,4'-thiobis(2-chloro-6-tert-butylphenol), 4,4'-thiobis(2-methoxy-6-tert-butylphenol), 4,4'-thiobis(2-ethyl-6-tert-butylphenol), 4,4'-butylidenebis(6-tert-butyl-m-cresol), 1-[α-methyl-α-(4'-hydroxyphenyl)ethyl]-4-[α',α'-bis(4"-hydroxyphenyl)ethyl]benzene, 1,1,3-tris(2-methyl-4-hydroxy-5-cyclohexylphenyl)butane, 1,1,3-tris(2-methyl-4-hydroxy-5-tertbutylphenyl)butane, 4,4'-thiobis(3-methylphenol), 4,4'-dihydroxy-3,3',5,5'-tetrabromodiphenyl sulfone, 4,4'-dihydroxy-3,3',5,5'-tetramethyldiphenyl sulfone, 2,2-bis(4-hydroxy-3,5-dibromophenyl)propane, 2,2-bis(4-hydroxy-3,5-dichlorophenyl)propane, 2,2-bis(4-hydroxy-3,5-dimethylphenyl)propane, etc., N,N'-bis(2-naphthyl)-1,4-phenylenediamine, sodium 2,2'-methylenebis(4,6-di-tert-butylphenyl)phosphate, an isocyanate compound, etc.

In this invention, various pigments can be used depending upon purposes such as an improvement in whiteness, prevention of adherence of foreign mater to a thermal head, etc., so long as they do not impair the desired effect intended for achieving the above object. Examples of the pigments include known pigments including white pigments such as diatomite, talc, kaolin, calcined kaolin, calcium carbonate, magnesium carbonate, aluminum hydroxide, magnesium hydroxide, titanium oxide, zinc oxide, silicon oxide, amorphous silica, amorphous calcium silicate, colloidal silica, colloidal alumina, calcium sulfate, barium sulfate, titanium dioxide, zinc sulfide, zinc carbonate, satin white, aluminum silicate, calcium silicate, magnesium silicate, alumina, lithopone, zeolite, hydrous halloysite, etc., resins composed mainly of monomers such as such as vinyl chloride, vinylidene chloride, vinyl acetate, methyl acrylate, ethyl acrylate, methyl methacrylate, acrylonitrile, styrene, etc., or organic hollow particles having shells formed of copolymer resins, etc., composed mainly of these monomers, organic pigments having through holes, organic pigments having opening portions, etc.

Further, there can be incorporated higher fatty acid metal salts such as zinc stearate, calcium stearate, etc., and waxes such as paraffin, paraffin oxide, polyethylene, polyethylene oxide, castor wax, etc., which are conventionally used for improving the anti-sticking property, and there can be incorporated various film curing agents, crosslinking agents, dispersing agents such as sodium dioctylsulfonate, etc., a surfactant, a fluorescent dye, a coloring dye, bluing agent, etc., for imparting water resistance.

In addition, an anti-oxidant and an ultraviolet absorbent can be incorporated for improving light resistance. Examples of the anti-oxidant include a hindered amine-based anti-oxidant, a hindered phenol-based anti-oxidant, a sulfide-based antioxidant, etc., while it shall not be specially limited thereto. Examples of the ultraviolet absorbent include organic compounds such as a benzotriazole-based ultraviolet absorbent, a salicylic acid-based ultraviolet absorbent, a benzophenone-based ultraviolet absorbent, etc., and inorganic materials such as zinc oxide, titanium oxide, cerium oxide, etc., while it shall not be specially limited thereto.

In this invention, the support on which the thermal recording layer is to be formed may be transparent, semi-transparent or non-transparent, and it can be selected from paper, various nonwoven fabrics, woven cloth, a synthetic resin film, synthetic resin laminated paper, synthetic paper, metal foil, ceramic paper, a glass sheet, or composite sheets obtained by combining these as required depending upon purposes.

In this invention, an intermediate layer may be formed between the thermal recording layer and the support for improving smoothness and heat-insulating property. The intermediate layer may contain various adhesives, organic pigments, inorganic pigments, hollow particles, etc.

In this invention, a protective layer may be formed on the thermal recording layer for the purpose of improving image stability, preventing scratches, improving water resistance and imparting glossiness and for other purposes. The protective layer may contain the vapor-phase synthesis silica in this invention, various adhesives, an organic pigment, an inorganic pigment, various hollow particles, various curing agents, various crosslinking agents, an ultraviolet absorbent, etc., and a single or two or more layers can be laminated. Further, printing of UV ink, etc., may be formed on the thermal recording layer or the protective layer.

In this invention, the surface opposite to the surface having the thermal recording layer may be provided with a back coating layer for preventing curling, charging, etc., and may be treated so as to adhere. The surface on which the thermal recording layer is formed or the opposite surface may be provided with a layer containing a material that admits electrical, magnetic or optical recording of information, an inkjet recording layer, a thermal transfer image receiving layer.

The method of forming each layer in this invention is not specially limited, and such layers can be formed by known techniques. For example, there can be employed application apparatuses such as an air knife coater, various blade coaters, various bar coaters, various curtain coaters, etc., or various printing methods such as lithography, letterpress, intaglio, flexography, gravure printing, screen printing, etc. Further, for improving surface smoothness, various known techniques in the production of thermal recording materials can be used, and, for example, a machine calender, a super calender, a gross calender, brushing, etc., can be used. The dry mass of the thermal recording layer is preferably 2 to 10 g/m$^2$, and the dry mass of the intermediate layer formed between the thermal recording layer and the support is preferably 4 to 20 g/m$^2$.

EXAMPLE 1

A thermal recording material used in Example 1 was prepared in the following manner and evaluated for properties. A vapor-phase synthesis silica was measured for an average secondary particle diameter with a laser diffraction/scattering particle size distribution analyzer supplied by HORIBA Ltd.

(1) Preparation of Thermal Recording Layer Coating Liquid

Each of the following dispersions (A) to (C) was wet-pulverized with a DYNO-MIL (supplied by Shinmaru Enterprises Corporation) until each had a volume average particle diameter of 0.8 μm.

| (A) Black color-forming dye precursor dispersion | |
|---|---|
| 10 mass % polyvinyl alcohol aqueous solution (supplied by Nippon Synthetic Chemical Industry Co., Ltd., trade name: GOHSERAN L3266) | 80 parts |
| 3-di-n-butylamino-6-methyl-7-anilinofluorane | 80.0 parts |
| Water | 70.0 parts |
| (B) Electron-accepting developer dispersion | |
| 10 mass % polyvinyl alcohol aqueous solution (supplied by Nippon Synthetic Chemical Industry Co., Ltd., trade name: GOHSERAN L3266) | 130.0 parts |
| 2,4'-dihydroxydiphenyl sulfone | 130.0 parts |
| Water | 110.0 parts |
| (C) Heat-meltable compound dispersion | |
| 10 mass % polyvinyl alcohol aqueous solution (supplied by Nippon Synthetic Chemical Industry Co., Ltd., trade name: GOHSERAN L3266) | 100.0 parts |
| 1,2-bis(3-methylphenoxy)ethane | 80.0 parts |
| N-hydroxymethylstearic acid amide | 20.0 parts |
| Water | 100.0 parts |

A thermal recording layer coating liquid composed of the following components was prepared.

| | |
|---|---|
| Dispersion A | 230.0 parts |
| Dispersion B | 370.0 parts |
| Dispersion C | 300.0 parts |

(2) Preparation of Intermediate Layer Coating Liquid

An intermediate layer coating liquid composed of the following components was prepared.

| | |
|---|---|
| 10 mass % sodium hexametaphosphate | 10.0 parts |
| Calcined kaolin (trade name: Ansilex, supplied by Engelhard Corporation) | 100.0 parts |
| 12 mass % starch oxide solution | 50.0 parts |
| 48 mass % SBR latex dispersion | 25.0 parts |
| Water | 79.0 parts |

(3) Formation of Intermediate Layer

The thus-obtained intermediate layer coating liquid was applied onto a wood free paper sheet with a blade coater such that a solid coating amount of 10 g/m$^2$ was obtained, and the applied coating liquid was dried to form an intermediate layer.

(4) Formation of Thermal Recording Layer

The thermal recording layer coating liquid prepared in (1) was applied onto the above intermediate layer such that a solid coating amount of 8 g/m$^2$ was obtained, and the applied coating liquid was dried. Then, the thus-coated paper was calender-treated such that it had a Bekk smoothness of 400 to 600 seconds, to give a thermal recording material of Example 1.

The thus-prepared thermal recording material was subjected to the following evaluations.

Evaluation 1 [Coloring Sensitivity]

Printing was conducted with a printing tester (apparatus name TH-TMD) supplied by Ohkura Electric Co., Ltd. at each of an application energies of 0.30 mJ/dot or 0.40 mJ/dot. In each case, a printing density was measured with a reflection densitometer model RD-19 supplied by Gretag Machbeth AG. Table 1 shows the evaluations results.

Evaluation 2 [Anti-Sticking Property]

Test printings were conducted at room temperature of 25° C. and 65% RH and a low temperature of minus 5° C. with a handy terminal printer (apparatus name: PREA CT-1) supplied by Canon Electronics, Inc., and in each case, the printing was evaluated for a sticking noise and a non-printing spot in the form of a white streak. Printing without a sticking noise or non-printing spot was evaluated as ◎ (double circle), printing with a sticking noise but without any non-printing spot was evaluated as ○ (single circle), printing that was with a sticking noise and non-printing spot but that had no problem in practical use was evaluated as Δ (triangle) and printing with a sticking noise and a non-printing spot that occurred intensely was evaluated as X. Table 1 shows the evaluation results.

| Vapor-phase synthesis silica aqueous dispersion | |
|---|---|
| AERODISP W1226 (26 mass % dispersion of AEROSIL OX50, vapor-phase synthesis silica having a specific surface area 50 m$^2$/g and bulk density 0.13 g/cc, average secondary particle diameter 150 nm, supplied by NIPPON AEROSIL CO., LTD.) | 150.0 parts |
| 40 mass % aluminum hydroxide aqueous dispersion (trade name: HIGILITE H42, supplied by SHOWA DENKO K.K.) | 300.0 parts |
| 50 mass % zinc stearate aqueous dispersion | 80.0 parts |
| 30 mass % paraffin wax aqueous dispersion | 60.0 parts |
| 10 mass % polyvinyl alcohol (trade name: NM-11, supplied by Nippon Synthetic Chemical Industry Co., Ltd.) | 850.0 parts |
| Water | 560.0 parts |

Evaluation 3 [Amount of Foreign Matter Adhering to Thermal Head]

A 1 km long continuous test printing was conducted with a POS register printer (apparatus name: TM-T88II) supplied by Seiko Epson Corporation at room temperature of 20° C. and 65% RH, and then, the printing was evaluated for foreign matter adhering to a thermal head. Printing with almost no adhering foreign matter was evaluated as ◎ (double circle), printing with slight adhering foreign matter was evaluated as ○ (single circle), printing that was with considerable adhering foreign matter but that had no problem in practical use was evaluated as Δ (triangle), and printing with a large amount of adhering foreign matter which caused a blur was evaluated as X. Table 1 shows the evaluation result.

Evaluation 4 [Strength of Thermal Recording Layer]

A mending tape made of NICHIBAN CO., LTD., was caused to adhere to a thermal recording layer surface, and peeled off with fingers to evaluate the thermal recording layer for a peel. A thermal recording layer with almost no peel was evaluated as ◎ (double circle), a thermal recording layer with a slight peel was evaluated as ○ (single circle), a thermal recording layer that was with a peel but that had no problem in practical use was evaluated as Δ (triangle), and a thermal recording layer with an intense peel was evaluated as X. Table 1 shows the evaluation result.

Evaluation 5 [Image Stability]

Printing was conducted with a printing tester (apparatus name: TH-PMD) supplied by Ohkura Electric Co., Ltd., at an application energy of 0.40 mJ/dot. A printed surface was wrapped with a vinyl wrap (trade name: HI-WRAP supplied by Mitsui Chemicals Fabro, Inc., and the printed sheet was left at room temperature for 3 days. The printed sheet was evaluated for an image discoloration that was caused by the migration of a plasticizer component in the vinyl chloride wrap into the thermal recording layer. The printed sheet was measured for a printing density with a reflection densitometer model RD-19 supplied by Gretag Machbeth AG each time before and after it was left, and a value obtained by dividing a printing density measured after it was left with a printing density measured before it was left, that is, an image retaining ratio was determined. Table 1 shows the evaluation result.

Evaluation 6 [Ground Fogging]

A thermal recording material was subjected to an acceleration test by leaving it in a constant-temperature constant-humidity chamber at 40° C. and at a relative humidity of 90° C. for 3 days, and it was evaluated for the occurrence of ground fogging. The thermal recording material was measured for a ground density with a reflection densitometer model RD-19 supplied by Gretag Machbeth AG each time before and after it was left, and a value obtained by dividing a ground density measured after it was left with a ground density measured before it was left, that is, a ground density change ratio was determined. Table 1 shows the evaluation result.

EXAMPLE 2

A thermal recording material was prepared in the same manner as in Example 1 except that the vapor-phase synthesis silica aqueous dispersion used in Example 1 was changed as follows, and it was subjected to Evaluations 1 to 5. Table 1 shows the evaluation results.

| | |
|---|---|
| 10 mass % AEROSIL 90G aqueous dispersion (supplied by NIPPON AEROSIL CO., LTD., specific surface area 90 $m^2/g$, bulk density 0.08 g/cc, average secondary particle diameter 210 nm) | 390.0 parts |

EXAMPLE 3

A thermal recording material was prepared in the same manner as in Example 1 except that the vapor-phase synthesis silica aqueous dispersion used in Example 1 was changed as follows, and it was subjected to Evaluations 1 to 5. Table 1 shows the evaluation results.

| | |
|---|---|
| 10 mass % AEROSIL 200 aqueous dispersion (supplied by NIPPON AEROSIL CO., LTD., specific surface area 200 $m^2/g$, bulk density 0.10 g/cc, average secondary particle diameter 320 nm) | 390.0 parts |

EXAMPLE 4

A thermal recording material was prepared in the same manner as in Example 1 except that the vapor-phase synthesis silica aqueous dispersion used in Example 1 was changed as follows, and it was subjected to Evaluations 1 to 5. Table 1 shows the evaluation results.

| | |
|---|---|
| AERODISP W1824 (supplied by NIPPON AEROSIL CO., LTD., 24 mass % dispersion of AEROSIL MOX80, vapor-phase synthesis silica that had a specific surface area 80 $m^2/g$ and bulk density 0.06 g/cc and that was doped with aluminum oxide, average secondary particle diameter 140 nm) | 162.5 parts |

EXAMPLE 5

A thermal recording material was prepared in the same manner as in Example 1 except that the vapor-phase synthesis silica aqueous dispersion used in Example 1 was changed as follows, and it was subjected to Evaluations 1 to 5. Table 1 shows the evaluation results.

| | |
|---|---|
| AERODISP W1836 (supplied by NIPPON AEROSIL CO., LTD., 36 mass % dispersion of AEROSIL MOX80, vapor-phase synthesis silica that had a specific surface area 80 $m^2/g$ and bulk density 0.06 g/cc and that was doped with aluminum oxide, average secondary particle diameter 140 nm) | 108.0 parts |

EXAMPLE 6

A thermal recording material was prepared in the same manner as in Example 1 except that the vapor-phase synthesis silica aqueous dispersion used in Example 1 was changed as follows, and it was subjected to Evaluations 1 to 5. Table 1 shows the evaluation results.

| | |
|---|---|
| AERODISP W1714 (supplied by NIPPON AEROSIL CO., LTD., 36 mass % dispersion of AEROSIL MOX170, vapor-phase synthesis silica that had a specific surface area 170 $m^2/g$ and bulk density 0.05 g/cc and that was doped with aluminum oxide, average secondary particle diameter 160 nm) | 278.0 parts |

EXAMPLE 7

A thermal recording material was prepared in the same manner as in Example 1 except that the vapor-phase synthesis silica aqueous dispersion used in Example 1 was changed as follows, and it was subjected to Evaluations 1 to 5. Table 1 shows the evaluation results.

| | |
|---|---|
| 5 mass % AEROSIL 300 aqueous dispersion (supplied by NIPPON AEROSIL CO., LTD., specific surface area 300 $m^2/g$, bulk density 0.05 g/cc, average secondary particle diameter 400 nm) | 780.0 parts |

EXAMPLE 8

A thermal recording material was prepared in the same manner as in Example 1 except that the composition of the electron-accepting developer dispersion (Dispersion B) used in Example 1 was changed as follows, and it was subjected to Evaluations 1 to 5. Table 1 shows the evaluation results.

| | |
|---|---|
| Diphenyl sulfones-bridged type compound dispersion | 130.0 parts |
| 10 Mass % polyvinyl alcohol aqueous solution (supplied by Nippon Synthetic Chemical Industry Co., Ltd., trade name: GOHSERAN L3266) | |
| Diphenyl sulfones-bridged type compound of the general formula (1) | 130.0 parts |
| Water | 110.0 parts |

EXAMPLE 9

A thermal recording material was prepared in the same manner as in Example 1 except that the vapor-phase synthesis silica aqueous dispersion used in Example 1 was changed like Example 7 and that the composition of the electron-accepting developer dispersion (Dispersion B) was changed like Example 8, and it was subjected to Evaluations 1 to 5. Table 1 shows the evaluation results.

EXAMPLE 10

A thermal recording material was prepared in the same manner as in Example 1 except that the vapor-phase synthesis silica aqueous dispersion used in Example 1 was changed like Example 5 and that the composition of the electron-accepting developer dispersion (Dispersion B) was changed like Example 8, and it was subjected to Evaluations 1 to 5. Table 1 shows the evaluation results.

COMPARATIVE EXAMPLE 1

A thermal recording material was prepared in the same manner as in Example 1 except that the vapor-phase synthesis silica aqueous dispersion used in Example 1 was omitted, and it was subjected to Evaluations 1 to 5. Table 1 shows the evaluation results.

COMPARATIVE EXAMPLE 2

A thermal recording material was prepared in the same manner as in Example 1 except that the vapor-phase synthesis silica aqueous dispersion used in Example 1 was omitted and that the composition of the electron-accepting developer dispersion (Dispersion B) was changed like Example 8, and it was subjected to Evaluations 1 to 5. Table 1 shows the evaluation results.

COMPARATIVE EXAMPLE 3

A thermal recording material was prepared in the same manner as in Example 1 except that the vapor-phase synthesis silica used in Example 1 was changed as follows, and it was subjected to Evaluations 1 to 5. Table 1 shows the evaluation results.

| | |
|---|---|
| 20 mass % precipitation method silica aqueous dispersion (supplied by Mizusawa Industrial Chemicals, Ltd., trade name: Mizukasil P-554A, specific surface area 400 $m^2/g$, bulk density 0.31 g/cc) | 195.0 parts |

COMPARATIVE EXAMPLE 4

A thermal recording material was prepared in the same manner as in Example 1 except that the vapor-phase synthesis silica used in Example 1 was changed as follows, and it was subjected to Evaluations 1 to 5. Table 1 shows the evaluation results.

| | |
|---|---|
| 20 mass % silica gel aqueous dispersion (supplied by Nippon Silica Kogyo K.K., trade name: Nipgel AZ-200, specific surface area 300 $m^2/g$, bulk density 0.15 g/cc) | 195.0 parts |

COMPARATIVE EXAMPLE 5

A thermal recording material was prepared in the same manner as in Example 1 except that the vapor-phase synthesis silica used in Example 1 was changed as follows, and it was subjected to Evaluations 1 to 5. Table 1 shows the evaluation results.

| | |
|---|---|
| 20 mass % colloidal silica aqueous dispersion (supplied by Nissan Chemical Industries, Ltd., trade name: SNOWTEX-C) | 195.0 parts |

TABLE 1

| | Evaluation 1 Coloring density | | Ev. 2 Sticking property | | Ev. 3 Foreign | Ev. 4 | Ev. 5 Image | Ev. 6 Ground |
|---|---|---|---|---|---|---|---|---|
| | 0.30 mJ/dot | 0.40 mJ/dot | Room temperature | Low temperature | matter to thermal head | Thermal recording layer strength | stability, Image retaining ratio | fogging, Density change ratio |
| Ex. 1 | 0.97 | 1.34 | ◎ | ◎ | ◎ | ◎ | 0.53 | 1.25 |
| Ex. 2 | 0.99 | 1.35 | ◎ | ◎ | ◎ | ◎ | 0.52 | 1.50 |
| Ex. 3 | 0.97 | 1.34 | ◎ | ○ | ◎ | ○ | 0.55 | 2.00 |
| Ex. 4 | 0.97 | 1.33 | ◎ | ◎ | ◎ | ◎ | 0.53 | 1.00 |
| Ex. 5 | 1.00 | 1.34 | ◎ | ◎ | ◎ | ◎ | 0.56 | 1.00 |
| Ex. 6 | 1.02 | 1.35 | ◎ | ◎ | ◎ | ◎ | 0.54 | 1.00 |
| Ex. 7 | 0.95 | 1.30 | ◎ | Δ | ○ | Δ | 0.53 | 2.00 |
| Ex. 8 | 0.79 | 1.25 | ○ | Δ | ○ | ◎ | 0.82 | 1.13 |
| Ex. 9 | 0.74 | 1.22 | Δ | Δ | Δ | Δ | 0.80 | 1.88 |
| Ex. 10 | 0.77 | 1.26 | ○ | ○ | ○ | ◎ | 0.81 | 1.00 |
| CEx. 1 | 1.03 | 1.36 | ○ | X | X | ◎ | 0.52 | 1.00 |
| CEx. 2 | 0.78 | 1.26 | Δ | X | X | ◎ | 0.80 | 1.00 |
| CEx. 3 | 0.92 | 1.28 | ○ | X | Δ | X | 0.54 | 1.00 |
| CEx. 4 | 0.90 | 1.29 | ○ | X | Δ | X | 0.55 | 1.25 |
| CEx. 5 | 0.92 | 1.27 | ○ | X | Δ | Δ | 0.51 | 1.38 |

Ev. = Evaluation, Ex. = Example, CEx. = Comparative Example

As is clear from the results in Table 1, Examples 1 to 7 carried out the contents of this invention and were excellent in Evaluations of coloring sensitivity, anti-sticking property, amount of foreign matter to a thermal head and layer strength, and of these, Examples 4 to 6 were free of any ground fogging. Further, Examples 8, 9 and 10 were excellent not only in coloring sensitivity, anti-sticking property, amount of foreign matter to a thermal head and layer strength but also in image stability, and of these, Example 10 was free of any ground fogging. In contrast, all of Comparative Examples 1 to 5 that did not contain the vapor-phase synthesis silica defined in this invention were insufficient in the anti-sticking property.

The invention claimed is:

1. A thermal recording material comprising a support and a thermal recording layer formed thereon, wherein:

the thermal recording layer comprises an electron-donating dye precursor and an electron-receiving developer that causes the dye precursor to develop a color, the thermal recording layer contains vapor-phase synthesis silica doped with aluminum oxide, and the vapor phase synthesis silica has a specific surface area of 50 to 200 $m^2/g$, as measured by a BET method.

2. The thermal recording material of claim 1, wherein the vapor-phase synthesis silica has an average secondary particle diameter of 500 nm or less.

3. The thermal recording material of claim 2, which contains, in the thermal recording layer, a diphenyl sulfones-bridged type compound of the following formula (1),

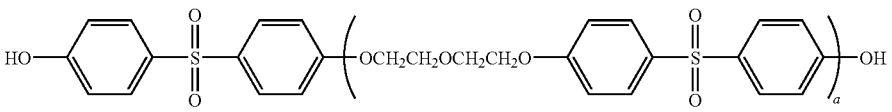

(1)

wherein a is an integer of 1 to 7.

4. The thermal recording material of claim 1, which contains, in the thermal recording layer, a diphenyl sulfones-bridged type compound of the following formula (1), (1)
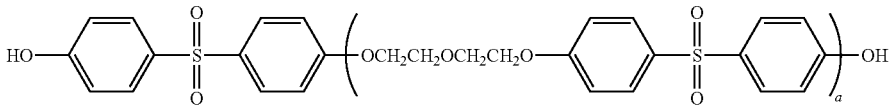
wherein a is an integer of 1 to 7.
* * * * *